US008938180B2

(12) United States Patent
Schroeder et al.

(10) Patent No.: US 8,938,180 B2
(45) Date of Patent: Jan. 20, 2015

(54) VENTILATING DEVICE AND METHOD FOR VENTILATING A HOUSING

(75) Inventors: Robert Gerd Schroeder, Felm (DE); Uwe Goldbeck, Kiel (DE)

(73) Assignee: Eastman Kodak Company, Rochester, NY (US)

( * ) Notice: Subject to any disclaimer, the term of this patent is extended or adjusted under 35 U.S.C. 154(b) by 343 days.

(21) Appl. No.: 13/498,330

(22) PCT Filed: Sep. 28, 2010

(86) PCT No.: PCT/EP2010/064345

§ 371 (c)(1),
(2), (4) Date: Jun. 11, 2012

(87) PCT Pub. No.: WO2011/039174

PCT Pub. Date: Apr. 7, 2011

(65) Prior Publication Data

US 2012/0243900 A1 Sep. 27, 2012

(30) Foreign Application Priority Data

Sep. 30, 2009 (DE) ..... 10 2009 047 775

(51) Int. Cl.
*G03G 15/00* (2006.01)
*G03G 21/20* (2006.01)

(52) U.S. Cl.
CPC ..... *G03G 21/206* (2013.01)
USPC ..... 399/92

(58) Field of Classification Search
USPC ..... 399/92, 90
See application file for complete search history.

(56) References Cited

U.S. PATENT DOCUMENTS

| | | | | |
|---|---|---|---|---|
| 2,800,853 | A | 7/1957 | Spear | |
| 5,572,403 | A | 11/1996 | Mills | |
| 2008/0170876 | A1 | 7/2008 | Sakai et al. | |
| 2008/0219693 | A1 * | 9/2008 | Kondo et al. | 399/92 |
| 2009/0010672 | A1 | 1/2009 | Watanabe | |

FOREIGN PATENT DOCUMENTS

| | | | | |
|---|---|---|---|---|
| AT | 321 827 | B | | 6/1974 |
| DE | 290 512 | | | 5/1991 |
| DE | 197 29 716 | A1 | | 6/1998 |
| DE | 102 50 099 | A1 | | 5/2003 |
| JP | 01188889 | A | * | 7/1989 |
| JP | 08262890 | A | * | 10/1996 |
| JP | 2009222866 | A | * | 10/2009 |
| SU | 1 121 548 | | | 10/1984 |

* cited by examiner

*Primary Examiner* — Quana M Grainger
(74) *Attorney, Agent, or Firm* — Christopher J. White; Raymond L. Owens

(57) ABSTRACT

A ventilating device for ventilating a housing, includes first and second blowers, a flow chamber with an inlet opening, an outlet opening, and an equalization opening connecting the flow chamber between the inlet opening and the outlet opening with the environment, a freely movable cover element for partially covering the equalization opening in such a manner that passage of the flow is blocked in one direction but cleared in the other direction, and an ascending pipe. The elements in the ventilating device are arranged in the sequence first blower, inlet opening, flow chamber, outlet opening, second blower, and ascending pipe. The equalization opening is at least partially open at all times, so that the equalization opening displays a greater flow resistance than the inlet opening of the flow chamber.

12 Claims, 5 Drawing Sheets

VENTILATING DEVICE AND METHOD FOR VENTILATING A HOUSING

CROSS-REFERENCE TO RELATED APPLICATIONS

This application is related to WO 2011/039174, published Apr. 7, 2011.

FIELD OF THE INVENTION

The present invention relates to a ventilating device and a method for ventilating a housing, in particular a printing machine housing, as well as to a support ventilator.

BACKGROUND OF THE INVENTION

In the art, it is generally known that warm or contaminated air is generated in the housings of the most varied devices, which air has to be removed. For example, in particular warm air must be removed in order to prevent overheating of the individual components inside the housing. In printing machines ozone, for example, can be generated or it is also possible for fine toner particles to be in the air, which should be ventilated. Consequently, it is necessary to provide appropriate ventilation of the housing.

In the art, the most varied ventilating devices are known, usually, e.g., printing machines comprise a blower in order to conduct air from the inside of the device housing directly to the outside into the immediate environment. However, in doing so, the potentially warm or contaminated air moves into the immediate environment of the device, this being potentially unpleasant for an operator of the device.

Therefore, it is also known to provide so-called support ventilators outside the device housing. Usually, support ventilators comprise a second blower and an ascending pipe in order to convey air exhausted from the device housing even farther, preferably out of the room in which the device is set up. The second blower, as a rule, is necessary because the device blower, as a rule, is not capable of conveying the air through the ascending pipe.

In the arrangement described above, a flow chamber is usually provided between the device blower and the blower of the support ventilator, said flow chamber being sealed with respect to the environment and consisting, for example, of only a tube. However, such an arrangement presents the problem that, for example, the device ventilator would no longer be able to convey air out of the device housing when the blower of the support ventilator fails. This could result in an overheating of individual components or in an unacceptable increase of the contamination level inside the device housing. In order to avoid such a situation, it is known to provide an electronic control that continually monitors the individual components and, for example, provides an emergency shut-off for the device in case of a malfunction of the support ventilator blower. If, however, the device blower would to fail but the blower of the support ventilator would continued to be operated, the blower of the support ventilator would continue to take in air—even though at a smaller volume—from the device housing, because the support of the device blower would be missing. This may result in inadequate ventilation and lead to the previously mentioned problems. In addition, the intake of air through the support ventilator blower could cause the device blower to move, this potentially resulting in further damage. In addition, the blower of the support ventilator, because it is now no longer supported by the device blower, could easily overheat and also be damaged. Consequently, an appropriate electronic control would also trigger an emergency shut-off of the device in such a case. However, as a rule, an emergency shut-off of a device is not desirable because this could lead to even more problems.

SUMMARY OF THE INVENTION

Accordingly, it is an object of the present invention to provide a simple ventilating device and a simple method for ventilating a device housing, in particular a printing machine housing, and thereby to avoid the aforementioned problems. Furthermore, it is an object of the invention to provide a simple support ventilator.

In accordance with the invention, a ventilating device as in claim 1, a method for ventilating a device housing as in claim 10, as well as a support ventilator as in claim 14 are provided. Additional embodiments of the invention can be learned from the dependent claims.

In particular, a ventilating device for ventilating a housing such as a printing machine housing comprises a first blower, a second blower, a flow chamber with an inlet opening and an outlet opening, and comprises an ascending pipe, wherein the elements are arranged in the direction of ventilation in the sequence of first blower, inlet opening, flow chamber, outlet opening, second blower and ascending pipe. In accordance with the invention, at least one equalization opening that is at least partially open at all times is provided, said equalization opening connecting the flow chamber between the inlet opening and the outlet opening with the environment, the at least one equalization opening displaying a greater flow resistance than the inlet opening of the flow chamber.

Due to the equalization opening in accordance with the invention it is possible to provide ventilation only via the first blower if the second blower should fail. It is true that the device air would be discharged directly into the environment of the device, however, the device could initially be continued to be operated, without impairing any internal processes. In particular, the device could be shut down in a controlled manner, meaning that processes in progress could be run to the end. Alternatively, depending on the exhaust air charge, the device could be operated during maintenance or replacement of the second blower so that no interruption would be necessary.

In addition, it is also possible to draw in environmental air through the second blower if the first blower fails in order to avoid an excessive strain of the first blower due to the air being sucked out of the device housing. As a result of the fact that the equalization opening displays a greater flow resistance than the flow chamber, it is ensured that the second blower will not only suck in environmental air but convey a smaller air flow out of the device housing. Thus, the ventilating housing in accordance with the invention provides a simple and cost-effective solution for ventilating a device housing not requiring complex control technology and avoiding at least a few of the aforementioned problems.

Preferably, the second blower features a suction power that is greater than that of the first blower in order to be able to convey a larger amount of air in normal operating mode than the first blower. As a result of this, it can be achieved that the device air will not escape through the equalization opening in normal operating mode, since air would be permanently sucked in from the environment. Preferably, the first blower is designed in such a manner that, in normal operating mode, said first blower is not suitable to blow air through the ascending pipe, whereas the second blower is designed therefor. As a result of this, it becomes possible to use a cost-effective standard blower for housing ventilation in the device housing independent of the installation conditions. Then, the second blower can be selected depending on the existing installation conditions such as, for example, the conveying height of the ascending pipe, etc. The first blower is designed in such a manner that it can convey air into the flow chamber and via the at least one equalization opening into the environment in case of failure of the second blower, in order to still be able to provide a ventilation of the device housing in the case of such a failure of the second blower.

In one embodiment of the invention, a supply line is provided between the first blower and the flow chamber, with the equalization opening defining a greater flow resistance than the supply line. As a result of this, a simple and flexible communication of an outlet opening of the device housing with the flow chamber is achieved.

In order to restrict the entry of contaminants and any access to the second blower, the equalization opening is preferably covered with a screen. In one embodiment of the invention, at least one freely movable cover element for partially covering the equalization opening is provided in such a manner that passage of the flow is blocked in one direction, however cleared in the other direction. As a result of this, it is possible to variably adjust the flow resistance into or out of the flow chamber and to the respective blower. Advantageously, the first blower is arranged in the housing that is to be ventilated.

In accordance with one embodiment of the invention, a printing machine comprising at least one housing and at least one ventilating device of the aforementioned type is provided, said ventilating device being connected with the housing of the printing machine in order to ventilate said housing.

In accordance with the inventive method for ventilating a housing, in particular a printing machine housing, housing air is conducted by means of a first blower out of the housing through an inlet opening into a flow chamber during normal operating mode. Then, by means of a second blower, the housing air is guided through an outlet opening out of the flow chamber and through an ascending pipe into the environment; while the second blower sucks in environmental air through at least one equalization opening that connects the flow chamber between the inlet opening and the outlet opening with the environment, and exhausts said air, together with the housing air, through the ascending pipe, the at least one equalization opening displaying a greater flow resistance than the inlet opening of the flow chamber.

Consequently, with the use of the method in accordance with the invention, environmental air and housing air are continually sucked in through the equalization opening and discharged through the ascending pipe in normal operating mode. Consequently, in a ventilating device of the aforementioned type, it is ensured that no housing air is exhausted into the immediate environment of the device housing because the second blower takes in environmental air through the equalization opening.

The second blower is preferably operated in such a manner that it conveys a volume of air that is greater by 1 to 10% than that of the first blower. As a result of this, it is ensured that, on the one hand, no housing air is conveyed into the immediate environment of the device housing and that, on the other hand, excessive strain of the second blower is avoided.

In accordance with one embodiment of the invention, the first blower will exhaust the housing air at least partially through the flow chamber and the at least one equalization opening to the environment if there is at least a partial failure of the second blower. In doing so, a ventilation of the housing device through the equalization opening can be provided even in case of a failure of the second blower. Consequently, an overheating of the individual components within the device housing can be prevented. Furthermore, it is possible to maintain operation of the device for a desired period of time until a process cycle is completed or a controlled shut-down of the device is ensured. In some case, operation may also be maintained until the second blower is repaired or replaced.

In an alternative embodiment, the second blower will take in a larger volume of environmental air then housing air in case of an at least partial failure of the first blower in order to prevent any excessive strain of the first blower that has experienced a partial failure.

The support ventilator in accordance with the invention comprises a suction opening, a flow chamber, a blower and an outlet opening in the stated sequence, said blower being arranged in such a manner that it can generate an air flow from the suction opening through the flow chamber to the outlet opening. Furthermore, the support ventilator comprises at least on equalization opening that is at least partially open at all times, said equalization opening connecting the flow chamber between the suction opening and the blower with the environment and the at least one equalization opening displaying a greater flow resistance than the suction opening. Such a support ventilator can be connected to the device housing without problem and provide the above-described device ventilation without requiring any complex electronic control. In order to prevent or make more difficult any entry of contaminants or an access to the blower of the support ventilator, the at least one equalization opening is preferably covered with a screen.

In accordance with another embodiment of the invention, at least one freely movable cover element disposed to at least partially cover the equalization opening is provided in such a manner that air is blocked from flowing through the equalization opening in one direction and, as opposed to this, cleared in the other direction. As a result of this, the flow resistance for a flow of air into the flow chamber and out of said flow chamber can be individually adjusted consistent with the environmental conditions.

BRIEF DESCRIPTION OF THE DRAWINGS

Hereinafter, the invention will be explained in greater detail with reference to the drawings. They show in FIG. 1 a schematic side view of a printing machine.

DETAILED DESCRIPTION OF THE INVENTION

Figure 1:
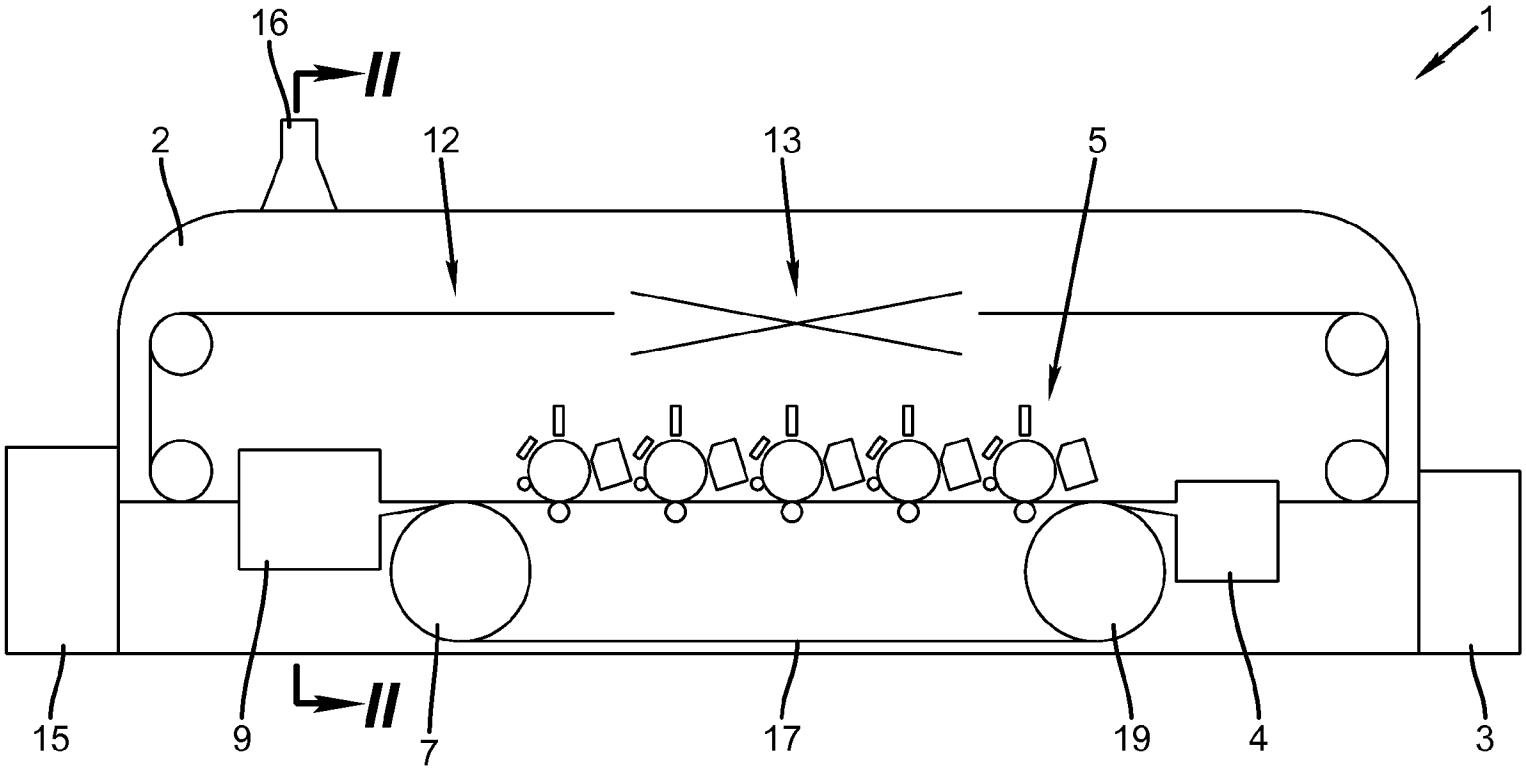

Information regarding locations and directions used in the description hereinafter relates primarily to the depiction in the drawings and should thus not be viewed as being restrictive. However, they may also relate to a preferred final arrangement.

FIG. 1 is a schematic side view of a multi-color printing machine 1 comprising a device housing 2, a feeder 3, an alignment unit 4, a plurality of printing units 5, a transport unit 7, a fixing unit 9, a duplex path 12 with a turning unit 13, as well as a stacker 15. Furthermore, a support ventilator 16 in accordance with the invention is indicated in the region of the fixing unit 9 in FIG. 1, said support ventilator being shown in greater detail in FIGS. 2 through 4. The most diverse embodiments of such multi-color printing machines are known, with FIG. 1 showing only a highly simplified example of such a machine.

The device housing 2 encloses the various units of the multi-color printing machine 1 with the exception of the feeder 13 and the stacker 15, the latter two being external units in the depicted embodiment. However, said feeder and said stacker may also be integrated in the device housing as is known in the art. The device housing 2 is disposed to protect the units inside the device housing 2 against contamination and unauthorized access. In addition, the device housing 2 is also disposed to protect operators of the multi-color printing machine 1.

The feeder 3 is disposed to receive a stack of sheets and to feed sheets to the alignment unit and is shown on a first end of the printing machine 1. The alignment unit 4 is of a type that is suitable for aligning sheets that have been placed on it and for transferring said sheets to the transport unit 7. The transport unit, again, is of a known type that is suitable for transporting sheets past the printing units 5. In the shown embodiment, the transport unit 7 comprises a circulating transport belt 17, said belt being guided around appropriate transport and guide rollers 19.

The printing units 5 are suitable for printing the respective color separation images on the sheets supplied by the transport unit 7. Five printing units are shown in the depicted multi-color printing machine 1, which printing units can be operated, for example, using the colors black, cyan, magenta, yellow and one custom color such as, for example, clear dry ink. Each of the printing units 5 is, for example, of a known electrophotographic type that applies toner to the respective sheets, said toner being subsequently fixed in the subsequent fixing unit 9.

However, the printing units 5 may also be of the so-called ink jet type, said printing units applying liquid toner to the respective sheets, in which case the fixing unit 9 could be a drying device drying the toner on the sheets in a suitable manner.

Hereinafter, independent of the printing units 5, reference is made to a fixing unit 9, irrespective of whether said fixing unit fixes a toner on the printing material and or an ink on the printing material. The toner may be fixed for example by means of heated nip rollers or also by other suitable devices such as, for example, a contactless heating device that operates with light or other electromagnetic radiation such as, for example microwaves. Likewise, a drying device may operate, for example, with light or electromagnetic radiation or hot air in order to dry the ink. Independent of the type of fixing unit, as a rule, a large amount of heat is generated in the region of the fixing unit, and, in the case of ink drying, also moisture is generated that must be removed in as controlled a manner as possible.

Downstream of the fixing unit 9 is the adjoining duplex path 12, said duplex path providing, in a manner known per se, a sheet conveyor path back to the alignment unit 4. The duplex path comprises a turning unit 13 that can turn a sheet conveyed along the duplex path 12 in a manner known per se. When a sheet is not to be directed to the duplex path 12 downstream of the fixing unit 9, said sheet may also be fed via an appropriate diverter to the stacker 15.

Figure 2:
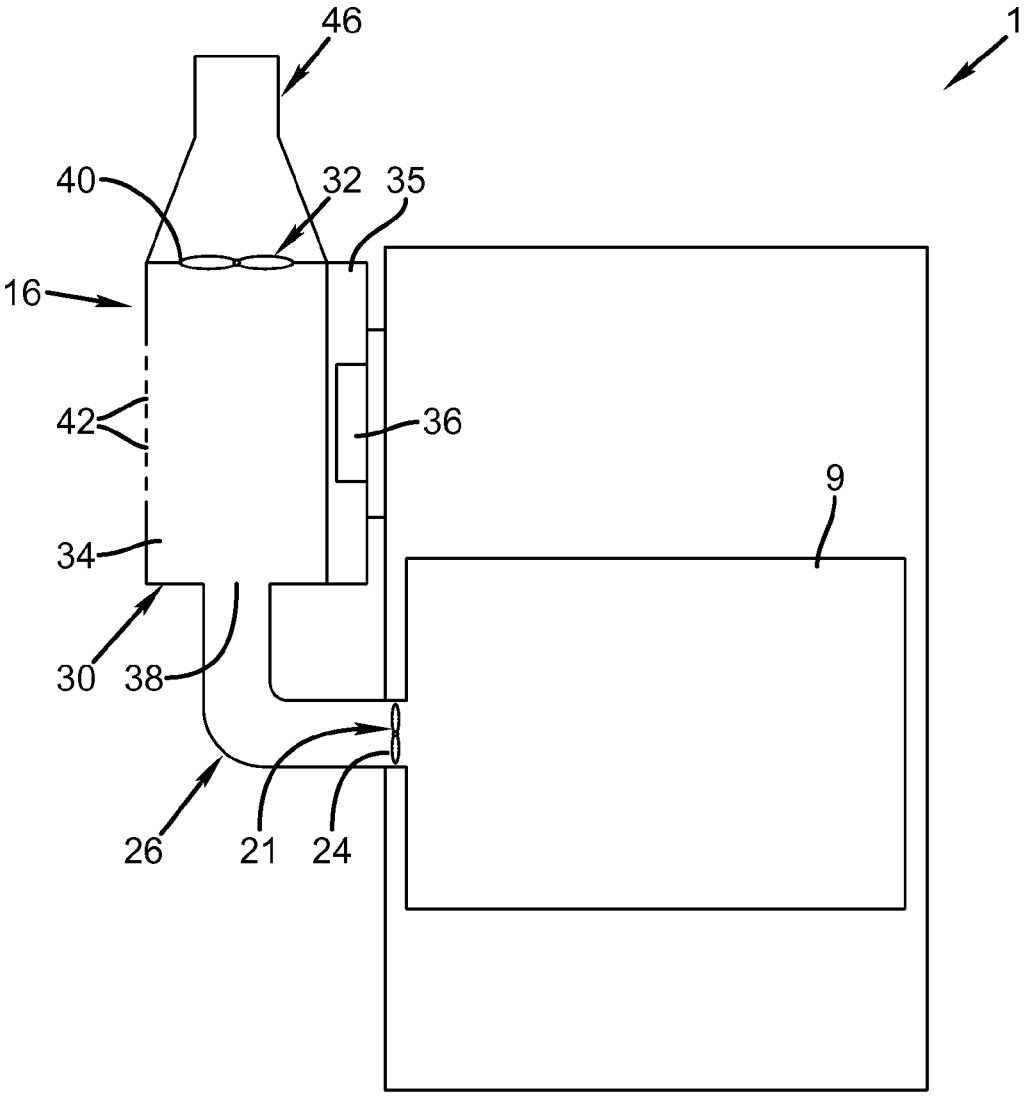
FIG. 2 a schematic sectional view of a ventilating device for a printing machine as in FIG. 1.

FIG. 2 is a schematic sectional view of the printing machine 1 in the region of the fixing unit 9, along line II-II in FIG. 1. As is obvious from FIG. 2, the support ventilator 16 is mounted to the rear side of the device housing 2 in the region of the fixing unit 9. Together with a device blower 21, said support ventilator forms a ventilating device for the printing machine and, in the depicted embodiment, in particular, for the region of the fixing unit.

The device blower 21 that is shown as a simple ventilator wheel, that, however, may also be a more complex blower, is arranged in such a manner that it can move air out of the interior space of the fixing unit 9 through an outlet opening 24 in the device housing 2 in order to, in doing so, exhaust heat, for example. A line 26 is provided in the region of the outlet opening 24, said line establishing a connection between the outlet opening 24 in the device housing 2 and the support ventilator 16.

The support ventilator 16 comprises a housing 30 and a support ventilator blower 32. The housing 30 is divided into a flow chamber 34 and a receiving chamber 35 for receiving an energy and/or control unit 36. However, the energy and/or control unit 36 may also be provided inside the flow chamber 34 or be installed outside the housing 30. The lower part of the housing 30 has an inlet opening 38 that opens toward the flow chamber 34. On an opposite, upper end of the flow chamber 24, the housing has an outlet opening 40. Furthermore, a lateral wall of the housing 30 is provided with a plurality of equalization openings 42 that connect the flow chamber 34 with the environment. The sum of equalization openings defines a greater flow resistance than the inlet opening 38 and than the flow chamber 34, of course.

The support ventilator blower 32, again, is indicated as a simple ventilator wheel, but it may, of course, also be designed in a different manner, and is installed in the region of the outlet opening 40 or on the housing 30. The support ventilator blower 32 is arranged in such a manner that it can convey air through the outlet opening 40 out of the flow chamber 34 and thus out of the housing 30.

Above the housing 30, there is an adjoining ascending pipe 46 that is only shown shortened. The depicted ascending pipe 46 is dimensionally relatively short, but it may also be longer or comprise a mounting device for a discharge pipe as is in the art. Although the ascending pipe is shown as a separate component, it may also be an integral part of the housing 30 of the support ventilator 16.

The support ventilator blower 32 is arranged in such a manner that said blower conveys the air conveyed out of the flow chamber 34 through the ascending pipe 46. For this, the support ventilator blower 32 must, of course, be adapted to the length and rising height of the ascending pipe 46 in order to provide sufficient blower power.

Figure 4:
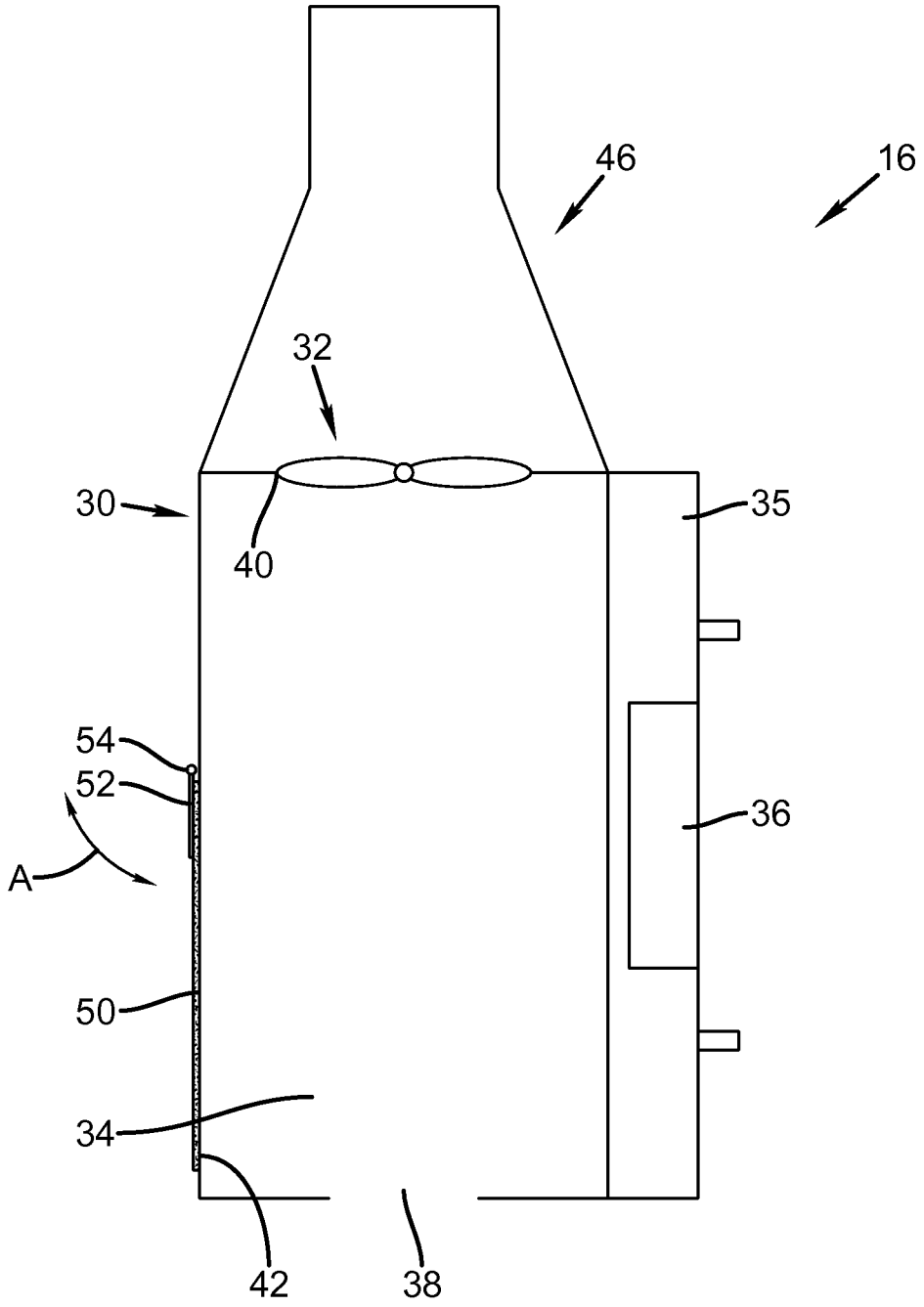
FIG. 4 a schematic sectional view of a support ventilator in accordance with one embodiment of the invention.

FIG. 4 is a schematic sectional view of a support ventilator 16 in accordance with an alternative embodiment. For identification of the same or similar elements, FIG. 4 uses the same reference signs as in FIG. 2.

The support ventilator 16, again, comprises a housing 30 and a support ventilator blower 32. The housing 30 is divided into a flow chamber 34 and a receiving chamber 35 for receiving an energy and/or control unit 36. A lower part of the housing 30 is provided with an inlet opening that opens toward the flow chamber 34. On an opposite, upper end of the flow chamber 34, an outlet opening 40 is provided in the housing 30, said outlet opening accommodating the support ventilator blower 32.

An equalization opening 42 is provided in a lateral wall of the housing 30, said equalization opening 42 connecting the flow chamber 34 with the environment. In contrast with the embodiment in accordance with FIG. 2, only one large equalization opening 42 is provided in the lateral wall of the housing 30, i.e., at the lower end of the flow chamber 34. The equalization opening 42 is covered by a removable screen 50. The screen 50 blocks the entry of coarser contaminants into the interior of the flow chamber 34 and, moreover, also blocks any unauthorized accidental access to the flow chamber 34.

The screen 50 is partially covered by a flap 52. The flap 52 is suspended from an appropriate hinge or joint 54 so as to be freely rotatable and to enable said flap to move away from and toward the screen 50, as is indicated by double arrow A in FIG. 4. Based on this, the person skilled in the art will see that the flap 52 will move away from the screen 50 when air flows out of the housing 30 and through the screen 50. When air flows through the screen 50 into the housing 30, the flap 52 will move toward the screen 50 and partially block the air flow. Due to the flap 52, there is a greater flow resistance for the air flow through the screen 50 into the housing 30 than for the air flow out of the housing 30. Thus, the dimensions of the flap 52 and the selection of the screen 50 can be used to achieve a desired flow resistance for a flow of air into the housing 30 and out of said housing through the equalization opening 42. Alternatively or also additionally, a corresponding flap may also be provided inside the housing 30 in order to at least partially cover the screen from the inside. Above the housing 30, an adjoining ascending pipe 46 is again provided.

Hereinafter, the operation of the printing machine 1 and, in particular the ventilating device, will be explained in greater detail. In conjunction with this, it should be noted that the ventilating device is provided in the region of the fixing unit 9 in order to remove heat and/or moisture occurring there. However, corresponding ventilating devices may also be provided at other locations of the printing machine, for example in the region of the printing units.

During the operation of the printing machine 1, a paper sheet is placed on the alignment unit 4 by way of the feeder, said sheet being aligned in a suitable manner. Subsequently, the paper sheet is transferred to the transport belt 17 of the transport unit 7. Then, the transport unit transports the paper sheet past the printing units, in which, in a manner known per se, for example by photographic means or also by means of an ink jet process, color separation images of a toner or ink picture are applied.

Subsequently, the sheet is conveyed to the fixing unit 9, in which the toner is fixed, for example by supplied heat, or the ink is dried, also by supplied heat.

Subsequently, the paper sheet is transported to the stacker 15 or, via the duplex path 12 and the turning unit 13, back to the alignment unit 4 in order to pass through another printing cycle.

Figure 3A:
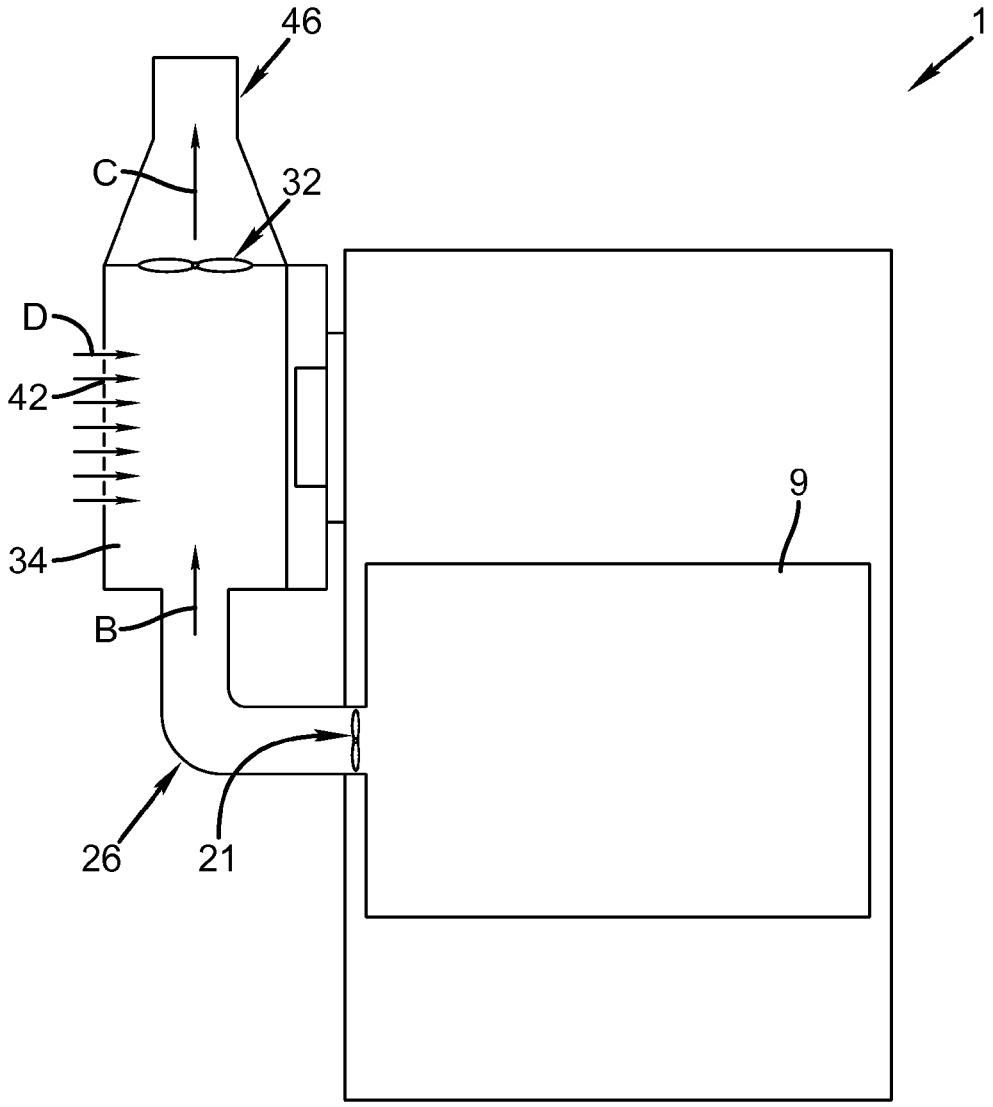
FIGS. 3 A and B each a schematic sectional view of the ventilating device as in FIG. 2 in different operating modes.
Figure 3B:
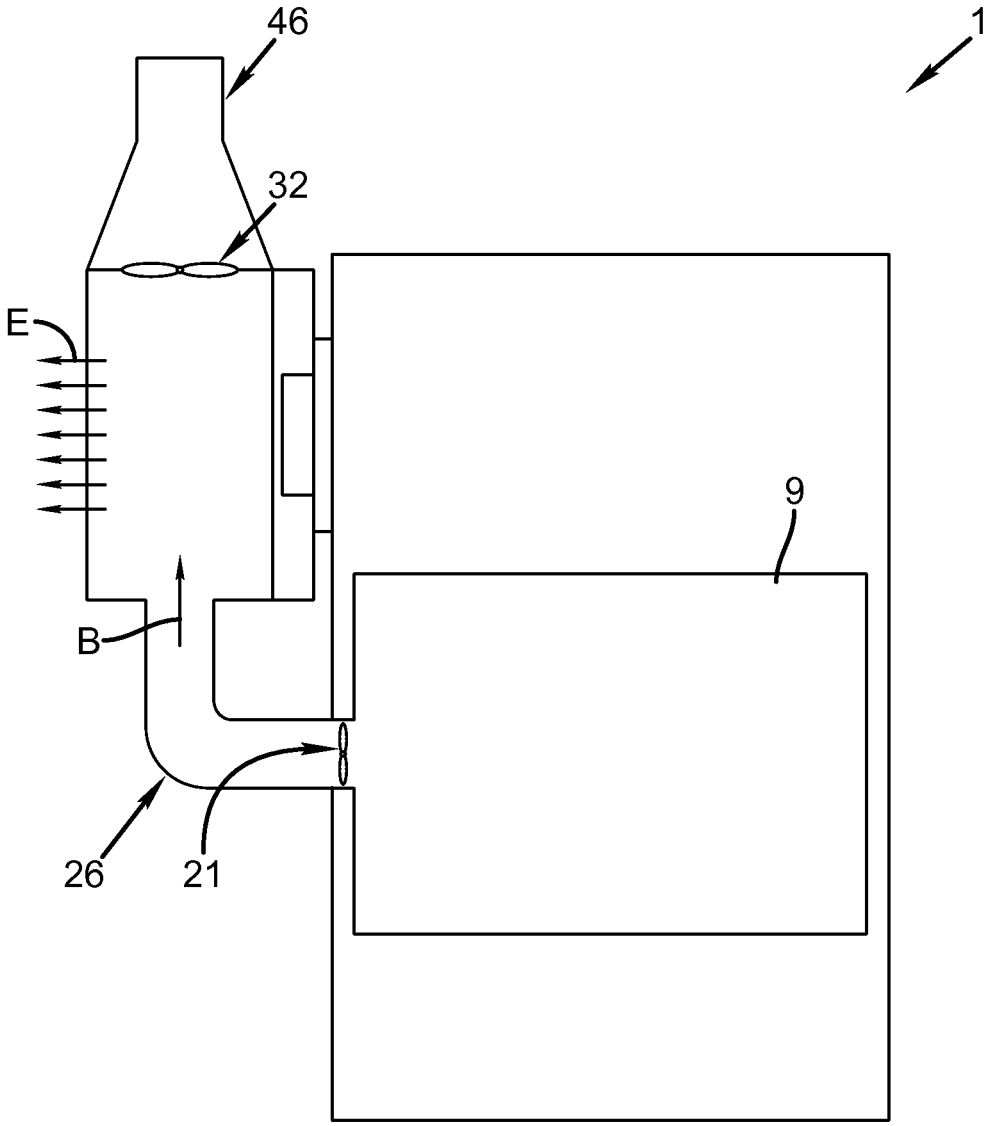

The ventilating device is being operated during the aforementioned operation. Hereinafter, the operation of the ventilating device with be explained in greater detail with reference to FIGS. 3A and 3B, FIG. 3A representing a normal operating mode, and FIG. 3B representing a first case of an error operating mode. In the normal operating mode in accordance with FIG. 3A, the device blower 21 is operated in such a manner that it conveys an air flow out of the fixing unit 9 through the line 26 into the flow chamber 34 of the support ventilator 16, as indicated by arrow B in FIG. 3A. In doing so, the blower 21 conveys a specific first volume of air. The support ventilator blower 32 is also operated, i.e., in such a manner that said support ventilator blower exhausts air from the flow chamber 34 through the ascending pipe 46, as indicated by arrow C. The support ventilator blower 32 is operated in such a manner that it conveys a second, larger volume of air than the device blower 21. This causes environmental air to be sucked in through the equalization openings 42 in the lateral wall of the housing 30 of the support ventilator 16, as is indicated by arrows D. This flow of environmental air into the flow chamber 34 prevents the device air, said air being conveyed by the device blower 21 to the flow chamber 34, from exiting to the environment. A precise adjustment of the device blower 21 to the support ventilator blower 32 is not necessary because an excess capacity of the support ventilator blower 32 can be equalized in a simple manner by sucking air in through the equalization openings 42. In systems that are not provided with equalization openings 42, the device blowers and the support ventilator blowers must be adapted to each other in order to prevent a stagnation between the blowers or to prevent the support ventilator blower 32 from also driving the device blower 21 by generating an excessive draft.

FIG. 3B shows a modification of the normal operating mode in accordance with FIG. 3A. In the operating modes in accordance with FIG. 3B, the support ventilator blower 32 is not operating, for instance, because of a malfunction of the support ventilator blower 32. In this situation, the device blower 21 continues to convey device air through the line 26 into the flow chamber 34, as is indicated by arrow B. As a result of the fact that the support ventilator blower 32 is not operating the device air is now, however, not removed through the ascending pipe 46 but is exhausted through the equalization openings 42 into the immediate environment of the printing machine 1, as is indicated by arrows E. As a result of this it is possible to initially maintain the operation of the printing machine in order to ensure a controlled shut-down of said printing machine, in order to complete specific printing cycles, and/or in order to be able to perform any potential maintenance and repair of the support ventilator blower 32. The latter could be provided, for example, as a modular component and be replaced on site by an operator in order to be able to again provide a normal operation. Inasmuch as a precise adaptation between the device blower 21 and the support ventilator blower 32 is not necessary as previously mentioned, such a replacement could be performed on site by the operator in a simple and speedy manner, if an appropriate modular design is provided.

In another operating mode that is not illustrated, the device blower 21 could fail completely or partially and could thus provide no or only minimal conveying of device air to the flow chamber 34. In such situations, the support ventilator blower 32 would indeed continue to remove air from the flow chamber 34 via the ascending pipe, however, this air would contain only a smaller proportion of device air. Rather, the blower 32 would suck in a larger proportion of environmental air through the equalization openings 42. In this case, the suction effect of the device air through the line 26 should be low enough for the blower 21 not to be excessively strained, which can be achieved by means of appropriate dimensioning of the equalization openings 42.

Hereinabove the invention has been explained in greater detail with reference to preferred embodiments, without being restricted to the specifically represented embodiments. In particular, a ventilating device or a support ventilator in accordance with the invention can also be used in combination with an apparatus other than a printing machine. If a printing machine is used, it is also possible to provide a printing machine of a different type such as, for example, a web printing machine that works with a web instead of with individual sheets. As mentioned, it is also possible to provide the ventilating device in accordance with the invention at various locations of a printing machine.

The invention claimed is:

1. Ventilating device for ventilating a housing, comprising:

a first blower, wherein the first blower is disposed in the housing that is to be ventilated;

a second blower;

a flow chamber with an inlet opening, an outlet opening, and an equalization opening connecting the flow chamber between the inlet opening and the outlet opening with the environment;

a freely movable cover element for partially covering the equalization opening in such a manner that passage of the flow is blocked in one direction but cleared in the other direction; and an ascending pipe, wherein the elements in the ventilating device are arranged in the sequence first blower, inlet opening, flow chamber, outlet opening, second blower, and ascending pipe;

the equalization opening is at least partially open at all times, so that the equalization opening displays a greater flow resistance than the inlet opening of the flow chamber; and wherein, the first blower is designed in such a manner that, in normal operating mode, the first blower is not suitable to blow air through the ascending pipe, whereas the second blower is designed therefore.

2. The ventilating device according to claim 1, wherein the second blower features greater suction power than the first blower.

3. The ventilating device according to claim 1, wherein the first blower is adapted to convey air into the flow chamber and, via the equalization opening, into the environment in case of failure of the second blower.

4. Method for ventilating a housing, comprising:

in a normal operating mode, conducting housing air using a first blower out of the housing through an inlet opening into a flow chamber, and conducting the housing air using a second blower through an outlet opening out of the flow chamber and through an ascending pipe into the environment; and using the second blower, sucking in environmental air through an equalization opening that connects the flow chamber between the inlet opening and the outlet opening with the environment, and exhausting the sucked air air, together with the housing air, through the ascending pipe, wherein the equalization opening is partially covered by a movable cover element, so that the equalization opening displays a greater flow resistance to flow into the flow chamber than out of the flow chamber, and the cover element blocks passage of air flow in one direction and clears it in the other direction.

5. The method according to claim 4, wherein the second blower is operated to convey a volume of air that is greater by 1 to 10% than the volume conveyed by the first blower.

6. The method according to claim 4, further including, in a failure mode in which there is at least a partial failure of the second blower, using the first blower to exhaust the housing air at least partially through the flow chamber and through the equalization opening to the environment.

7. The method according to claim 6, wherein, in the failure mode, the second blower sucks in a larger volume of environmental air than housing air.

8. Support ventilator comprising:

a suction opening, a flow chamber, a blower, and an outlet opening, these elements being arranged in the previously stated sequence, the blower adapted to generate an air flow from the suction opening through the flow chamber to the outlet opening;

an equalization opening that is at least partially open at all times, the equalization opening connecting the flow chamber between the suction opening and the blower with the environment, so that the equalization opening displays a greater flow resistance than the suction opening; and a freely movable cover element partially covering the equalization opening so that passage of the flow is blocked in one direction but cleared in the other direction.

9. The support ventilator according to claim 8, further including a screen covering the at least one equalization opening.

10. The ventilating device according to claim 1, wherein the housing is a housing of a printing machine, and the ventilating device ventilates the housing.

11. A ventilating device for ventilating a housing, comprising:

a first blower, wherein the first blower is disposed in the housing that is to be ventilated;

a second blower;

a flow chamber with an inlet opening, an outlet opening, and an equalization opening connecting the flow chamber between the inlet opening and the outlet opening with the environment;

a freely movable cover element for partially covering the equalization opening in such a manner that passage of the flow is blocked in one direction but cleared in the other direction; and an ascending pipe, wherein the elements in the ventilating device are arranged in the sequence first blower, inlet opening, flow chamber, outlet opening, second blower, and ascending pipe;

the equalization opening is at least partially open at all times, so that the equalization opening displays a greater flow resistance than the inlet opening of the flow chamber; and a supply line between the first blower and the flow chamber, wherein the equalization opening defines a greater flow resistance than the supply line.

12. A ventilating device for ventilating a housing, comprising:

a first blower, wherein the first blower is disposed in the housing that is to be ventilated;

a second blower;

a flow chamber with an inlet opening, an outlet opening, and an equalization opening connecting the flow chamber between the inlet opening and the outlet opening with the environment;

a freely movable cover element for partially covering the equalization opening in such a manner that passage of the flow is blocked in one direction but cleared in the other direction; and an ascending pipe, wherein the elements in the ventilating device are arranged in the sequence first blower, inlet opening, flow chamber, outlet opening, second blower, and ascending pipe;

the equalization opening is at least partially open at all times, so that the equalization opening displays a greater flow resistance than the inlet opening of the flow chamber;

a supply line between the first blower and the flow chamber, wherein the equalization opening defines a greater flow resistance than the supply line; and a screen covering the equalization opening.

* * * * *